US005918389A

United States Patent [19]

Hall

[11] Patent Number: 5,918,389

[45] Date of Patent: Jul. 6, 1999

[54] SCRAPER BLADE FOR TOOTHED BUCKETS OF EARTH WORKING MACHINES

[75] Inventor: William I. Hall, Fort Madison, Iowa

[73] Assignee: Hall's Dirt Squeege Blade, Inc., Fort Madison, Iowa

[21] Appl. No.: 09/010,932

[22] Filed: Jan. 22, 1998

[51] Int. Cl.[6] ..... E02F 3/76

[52] U.S. Cl. ..... 37/407; 37/455; 37/903

[58] Field of Search ..... 37/903, 407, 444, 37/450, 455, 446

[56] References Cited

U.S. PATENT DOCUMENTS 3,765,109 10/1973 Daviduke .
3,942,271 3/1976 George .
4,009,529 3/1977 Johnson .
4,023,288 5/1977 Roe .
4,189,854 2/1980 Haynes .
4,208,815 6/1980 Yunker et al. .
4,230,435 10/1980 Azevedo .
4,360,980 11/1982 Jarvis .
4,521,980 6/1985 Solaja .
5,062,228 11/1991 Artzberger .
5,142,799 9/1992 Wood .

*Primary Examiner*—Christopher J. Novosad
*Attorney, Agent, or Firm*—Thomas E. Frantz

[57] ABSTRACT

A scraping blade adapted for quick, simple and easy attachment to and removal from a bucket of the type used with a backhoe or like earth working machine, wherein the lower cutting edge of the bucket has a plurality of outwardly projecting teeth terminating in tapered cutting/tearing points. The blade includes front and back plates providing a straight lower scraping edge and a substantially "V" shaped upwardly open receptacle or socket sized and configured to receive and snugly engage the projecting points of the bucket teeth. The front plate includes forwardly angled end sections adapted to prevent the spill over of dirt from the blade as it is being used to scrape and/or level dirt. The blade is releasably yet securely held in position on the bucket by a binder device consisting of a tether attached to the blade generally intermediate its ends, a hook attachable to a fixed support carried by the bucket, and a binder device releasably coupled to the tether and hook, the binder device being manually operable to pull the tether toward the fixed support to seat and maintain the teeth points in the blade socket under tension sufficient to prevent undesired shifting or movement of the blade relative to the bucket or its teeth as the blade is being used to scrape or level dirt.

11 Claims, 4 Drawing Sheets

SCRAPER BLADE FOR TOOTHED BUCKETS OF EARTH WORKING MACHINES

FIELD OF THE INVENTION

This invention relates to an attachment for toothed buckets of the type used on earth working equipment, and more particularly to a system by which a scraper blade is quickly, easily and securely mounted by one person without tools over the cutting/ripping teeth of such a bucket to provide a straight lower scraping edge which will leave a relatively smooth even surface when the bucket with mounted blade is used for such work as leveling, grading or back filling dirt into an open trench or other excavation.

BACKGROUND OF THE INVENTION

In the usual building or construction project, considerable trenching and digging normally are required as a part of such work as pouring concrete footings and foundations, laying water lines, installing drainage tile and sewer pipes and systems, uncovering existing utility pipes and lines, waterproofing and reinforcing existing foundations, and the like. Much of this trenching and digging is accomplished by the use of an earth working machine designed primarily for that type of work, such as a backhoe or similar machine equipped with a hydraulically operated boom provided at its distal end with a bucket capable of digging into and picking up and removing dirt, rocks, rubble, and like materials (all hereinafter generally called "dirt"). The cutting edge of the bucket is provided with a row of outwardly projecting heavy duty pointed teeth designed to withstand considerable abuse and pressure in order to accomplish the ripping and cutting normally necessary to penetrate, break and pick up the dirt being excavated, In a construction or building project of any significant size, use of a backhoe or similar boom equipped machine normally is used primarily for such work as digging and trenching and not for back filling, leveling or grading because of certain problems inherent in using a toothed bucket for such "finishing" work. Instead, a separate grader or end loader with a straight edge scraper blade normally is employed to push dirt back into the trenches and excavations and perform other leveling and grading operations around the construction site.

On smaller or emergency jobs requiring use of a backhoe, however, a separate grader or end loader seldom is available. This makes it necessary on such jobs to refill trenches and excavations and otherwise level and grade dirt either manually or with the backhoe, or using a combination of the two.

As those in the construction business are aware, the normal backhoe bucket is quite unsatisfactory for use in scraping dirt back into a trench or excavation or in leveling or grading a work area because of the presence of the teeth on the lower edge of the bucket. If the bucket is held high enough to avoid penetration of the teeth into the ground being cleared, considerable dirt is left behind and must then be raked or shoveled manually. Or if the bucket is lowered enough to scrape most of the dirt from the ground to be cleared, the teeth will penetrate into and tear and damage the ground, thus again requiring manual leveling and finishing.

In some cases, the operator may be able to position his or her backhoe and boom such that the side of the bucket can be used to scrape dirt back into a trench or excavation without excessively tearing up the ground being cleared. Even this contingency is far from satisfactory, however, as the bottom edge of the side of a bucket is relatively narrow, normally is curved and thus does not scrape evenly, and has no provision for preventing the "spill over" of dirt or other material from the sides of the bucket, thus necessitating an excessive number of passes of the bucket.

The problems discussed above have long been recognized by those in the field, and several proposals have been made for their solution. For instance, to adapt the usual toothed bucket for scraping and back filling, it has been suggested that a separate straight edge blade be positioned over and bolted, clamped or otherwise attached to the teeth or the bucket. For a variety of reasons, however, none of these prior proposals have proven satisfactory or met with any significant commercial success. Accordingly, until development of the present invention, the industry has continued to experience problems in trying to use the usual toothed backhoe bucket for back filling, scraping, leveling or otherwise grading dirt.

OBJECTS OF THE INVENTION

Accordingly, it is an object of this invention to provide a system for easily and quickly adapting a toothed earth working bucket for uses other than trenching and digging.

Another object of the invention is the provision of a scraper blade which can be mounted quickly, easily and securely over the teeth of an earth working bucket to adapt the bucket for use in back filling, scraping and leveling dirt.

A still further object of this invention is to provide an improved system for easily and quickly mounting a scraping and leveling blade on a toothed earth working bucket without modifying or changing the bucket.

An additional object of the invention is the provision of a scraper blade which can be mounted on earth working buckets of various widths and with various numbers of teeth and which is safe, convenient and efficient in its application and use.

Yet an additional object of the invention is to provide an inexpensive yet tough and long lasting scraping and leveling blade adapted to be mounted quickly and easily by one person over the teeth of the usual earth working bucket without the use of tools or special equipment of any kind.

A still further object of this invention is the provision of a scraper blade for a toothed bucket, the blade having a substantially straight lower scraping edge and angled end sections which resist the spill-over of dirt from the blade.

These and other objects, features and advantages of the present invention will be apparent from the following summary and description of the preferred embodiments when taken in conjunction with the accompanying drawings.

SUMMARY OF THE INVENTION

As pointed out hereinabove, contractors and workers in the construction industry have long sought a practical way to employ a toothed earth working bucket as a scraper blade to level and smooth the bottom of trenches, to back fill trenches and other excavations, to level and grade loose dirt, or otherwise move dirt over a surface without danger that such surface will be damaged or left with ridges and grooves by the teeth of the bucket.

The present invention provides a unique system which not only successfully addresses the above discussed needs of the construction industry but avoids the problems and disadvantages inherent in the various proposals advanced in the past by others in an effort to satisfy those needs. These advantages and features are provided in the preferred embodiment of the present invention by the combination of a unique scraper blade and novel binder means which permit secure mounting of the blade over the teeth of the bucket of a backhoe or like machine at the work site easily, quickly and safely by one person without the need for tools or other aids of any kind. Subsequent removal of the blade from the bucket to permit its use in the normal manner for digging and trenching likewise is simple, safe and conveniently handled by one person without tools or other aids.

The scraper blade consists of a front plate having a generally rectangular center section terminating at each end in an angularly disposed end section, a generally rectangular back plate substantially equal in size to and positioned in general congruence with the center section of the front plate, and a plurality of spacers disposed between the plates. The lower edge of the back plate is welded to or otherwise permanently connected or joined to the center section of the front plate proximate its lower edge, with the two plates diverging away from each other at an angle approximately equal to the taper of the teeth which project outwardly of the cutting edge of the bucket. The spacers are cut at the same angle as the taper of the teeth, and are disposed between and welded or otherwise permanently affixed to the plates. One spacer is positioned at each end of the center section, with additional spacers being disposed at pre-selected positions between the ends. The two plates and spacers thus define an upwardly open receptacle or "socket" sized to snugly and securely yet releasably receive the outer pointed ends of the teeth of the bucket at such time as the operator of the backhoe elects to place the blade on the bucket for scraping or leveling purposes.

In assembling the scraper blade, the front and back plates are positioned such that the end sections of the front plate are angled forwardly of the center section to act as "guides" to move dirt toward the center section of the blade as dirt is accumulated during scraping movement of the blade. Accordingly, unless the blade has been permitted to accumulate an excessive amount of dirt, the angled end sections will prevent the overflow or "spill-over" of dirt as it is being moved, thus maximizing the effectiveness of the blade.

The scraper blade is held securely on the teeth of the bucket by the aforesaid binder means, comprising anchor means for attachment to a fixed support member carried by the bucket, connector means carried by the blade intermediate its ends, and a binder assembly operatively disposed between and releasably connected by the anchor means to the fixed support member of the bucket and the connector means of the blade. The binder assembly has an operating element which is manually movable in one direction to pull the connector means toward the support member and secure the blade tightly over the teeth of the bucket, and in a second direction to relieve the tension on the connector means and permit disconnection of the binder assembly and anchor means from the fixed support member and removal of the blade from the bucket.

Although a scraper blade designed according to the present invention is quite rigid and strong, it is relatively light. Accordingly, a single person of normal strength should have no difficulty in picking up one of the blades, placing the blade over the teeth of the usual backhoe bucket, and then in securing the blade to the bucket with the manually operated binder means. Alternately, should the operator of a backhoe wish to do so, the blade could be mounted simply by standing it upright on the ground, positioning the bucket over the blade with the teeth aligned with the socket between the plates of the blade, lowering the bucket to insert the teeth into the socket, and manually connecting and operating the binder assembly to secure the blade on the teeth. Removal of the blade would simply involve a reversal of these simple steps. Regardless of the mounting procedure selected, however, installation and removal of the blade would be accomplished

- quickly (requiring perhaps a minute or two at the most),
- safely (not even requiring that the blade be picked up by the operator) and
- without tools or other aids (all steps being performed manually).

As will be understood from the following discussion, this invention is not limited to a blade of any particular length or height as both dimensions normally would be selected based on the width of the bucket on which the blade is to be used and the amount and kind of dirt or other material to be moved. Further, from the following description, it will be understood that this invention is not limited to any specific type of binder means or assembly. Also, while the following description and the accompanying drawings refer primarily to and illustrate toothed buckets for backhoes, the invention is applicable to toothed buckets as used on other types of equipment, such as end loaders.

DESCRIPTION OF THE PREFERRED EMBODIMENT

Figure 1:
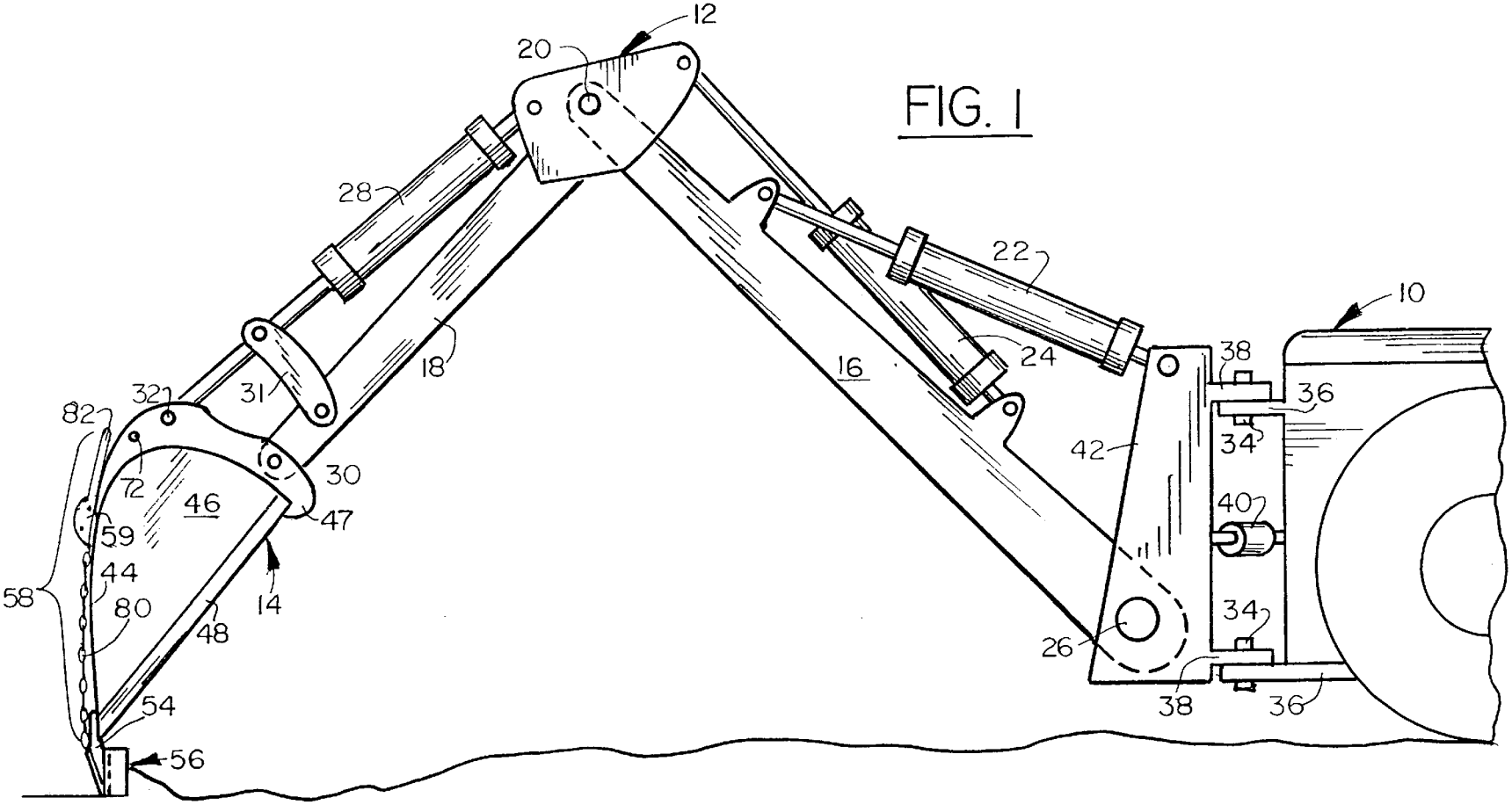
FIG. 1 is a side elevational view of a scraper blade according to the present invention shown mounted and in use on a toothed bucket carried at the distal end of the boom of a backhoe, partially illustrated.

Continuing now with a more detailed description of the drawings, reference is first made to FIG. 1 showing the front section of an earth working machine 10 of the type having a boom 12 which carries at its distal end the usual toothed bucket 14. The boom 12 of this machine, commonly called a backhoe, includes inner and outer arms 16 and 18 which are connected by a pivot pin 20 and which are selectively raised and lowered during operation of the machine by hydraulic cylinders 22 and 24. As will be clear from the drawing, activation of cylinder 22 will cause inner arm 16 to move in an arc around the main support axle 26 and activation of cylinder 24 will cause outer arm 18 to move in an arc around pivot pin 20. The position of the bucket around pivot rod 30 is then controlled by the combination of the cylinder 28 and link 31 acting through the operating pin 32 in a manner well known in the field.

The entire boom assembly 12 is mounted on and movable back and fourth in an arc around a pair of aligned shafts 34 which rotatably connect support arms 36 of the backhoe 10 and support arms 38 of the boom 12. Movement of boom 12 is then controlled by hydraulic cylinder 40 which is connected at one end to the backhoe 10 and at the other end to the mounting bracket 42 of boom 12. Thus, as dirt is picked up in the bucket 14 while in use in a trenching or digging operation, the bucket can be swung to either side of the trench or excavation before being emptied.

Figure 3:
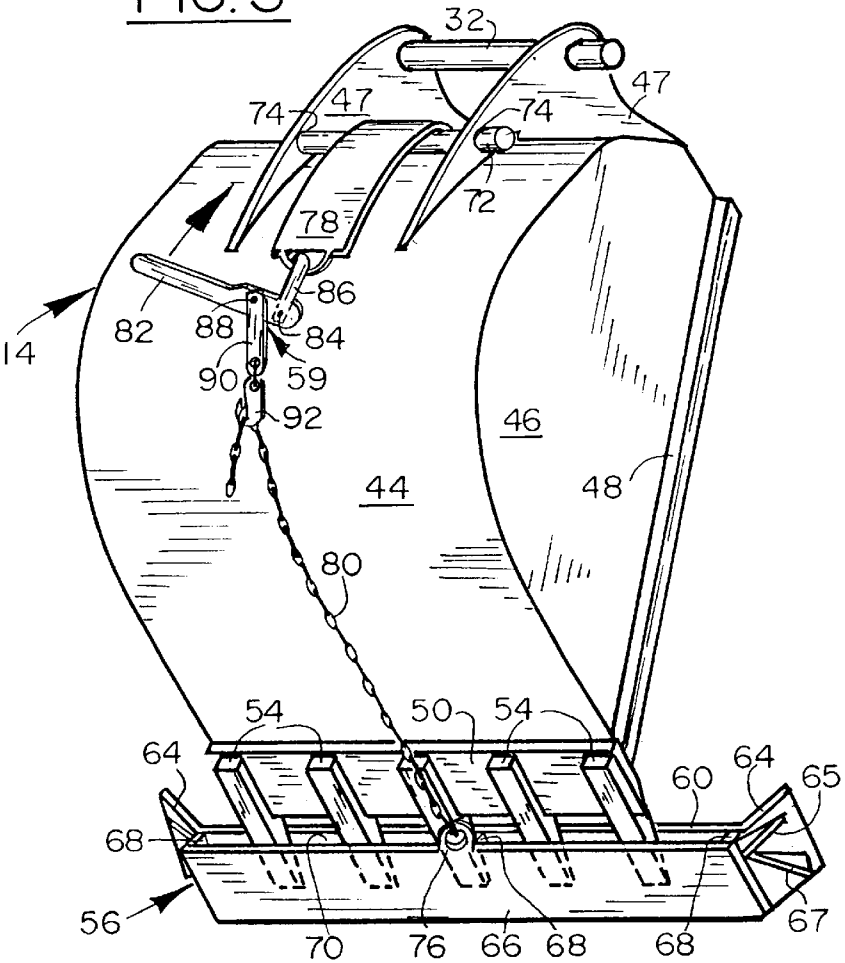
FIG. 3 is a back perspective view of the toothed bucket and attached scraper blade and binder means illustrated in FIG. 1 FIG. 3A consists of an enlarged fragmentary view of the binder assembly 59 as shown in small scale in FIG. 3.
Figure 2:
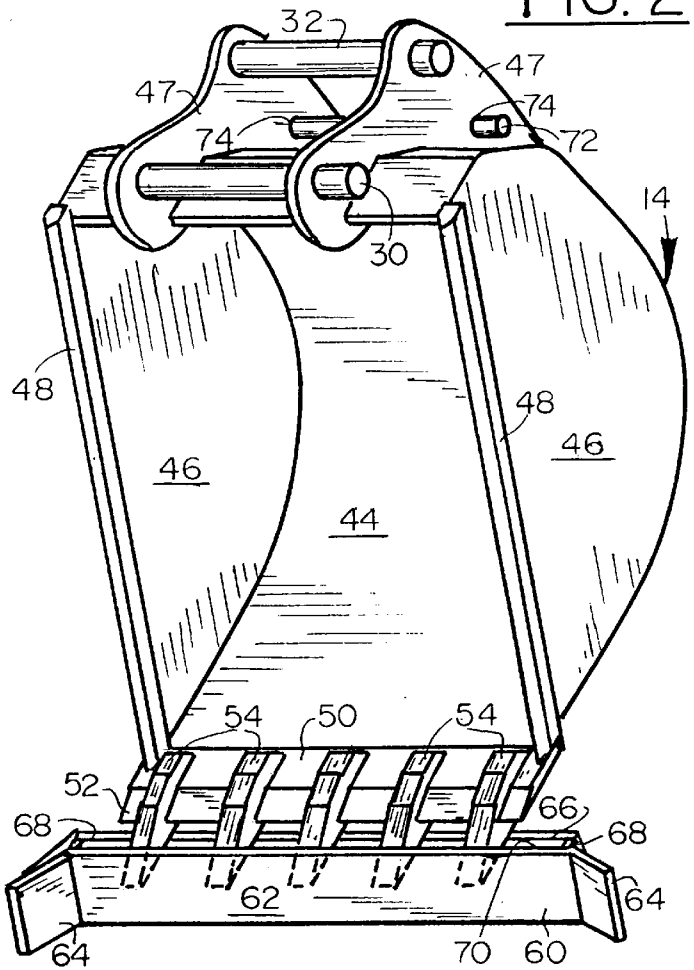
FIG. 2 is a front perspective view of the toothed bucket and attached scraper blade illustrated in FIG. 1.
Figure 4:
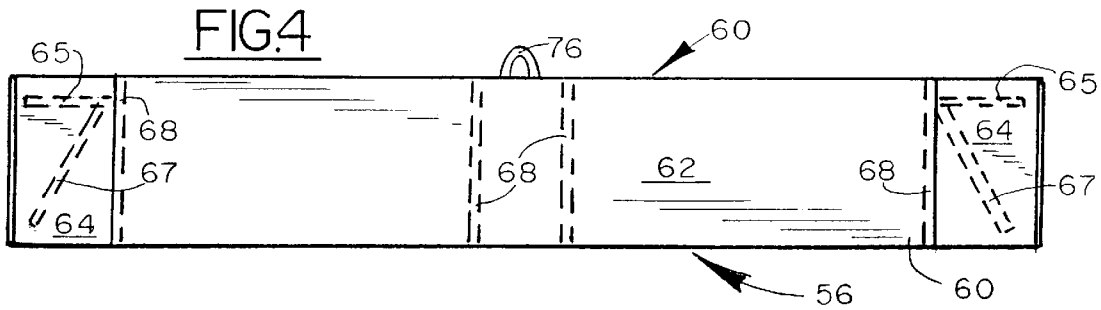
FIG. 4 is front elevational view of the scraper blade of FIGS. 1,2 and 3.
Figure 5:
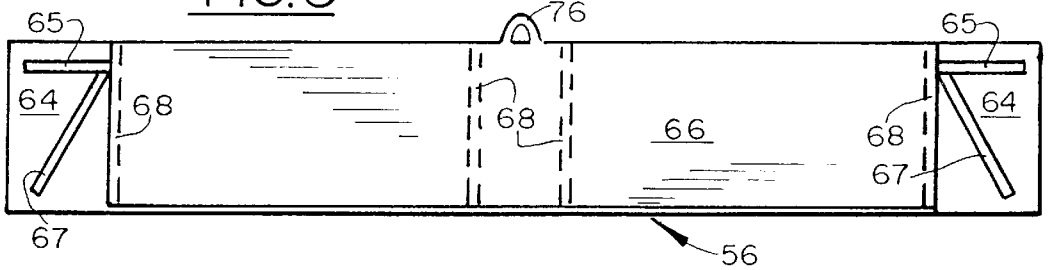
FIG. 5 is a back elevational view of the scraper blade of FIGS. 1,2 and 3.
Figure 6:
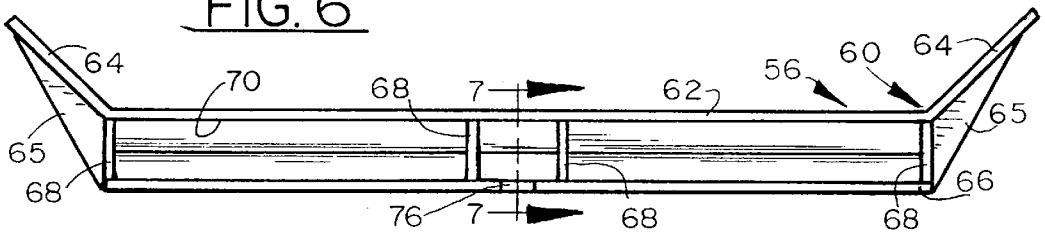
FIG. 6 is a top plan view of the scraper blade of FIGS. 1, 2 and 3.
Figure 3A:
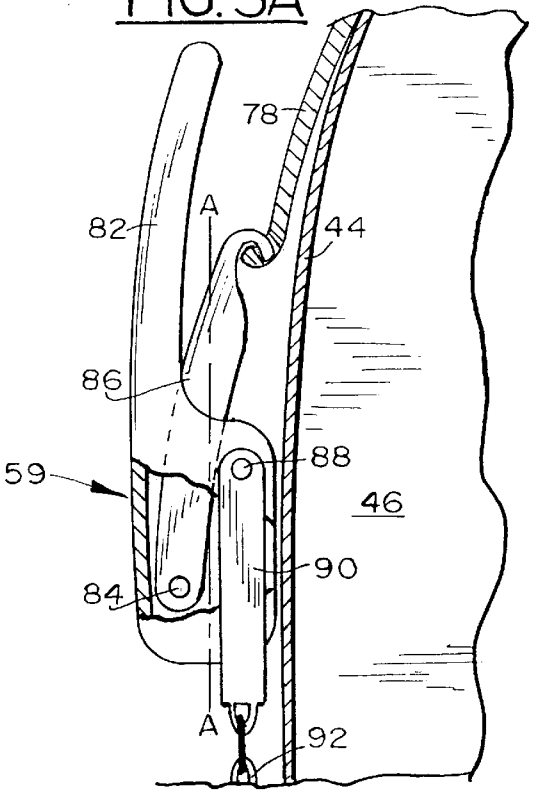

Referring particularly to FIGS. 2 and 3, the bucket 14 is of the usual design and construction, being formed of a tough steel sheet material, with a curved back wall 44 and generally parallel side walls 46. Two mounting brackets 47 are welded or otherwise permanently affixed in a spaced parallel relationship to the exterior of the bucket 14 over its upper end and are provided with sets of aligned apertures as are necessary to receive and hold pivot rod 30, operating pin 32 and an additional support rod to be described hereinafter. The forward or leading edge of each side wall 46 preferably is protected and reinforced by a rigid steel frame member 48 which is provided with a pointed leading edge. Further, a relatively thick reinforcing bar 50 formed of a tough steel alloy, is mounted over the lower terminal end of the back wall 44. As with the frame members 48, the leading edge of the reinforcing bar 50 is tapered to a relatively sharp point 52 to assist in cutting through hardened or compacted dirt while the bucket is being used for digging or trenching.

Mounted on and spaced across the reinforcing bar 50 are a plurality of pointed teeth 54 which are formed of a hard, tough and long wearing steel and which are needed in order to cut into and/or break up and loosen whatever compacted dirt, rocks, rubble or other materials that may be encountered at the construction site where the backhoe is being used. It will be understood, therefor, that the use of cutting/ripping teeth are necessary if the bucket of a backhoe or like digging machine is to perform the work for which it is intended. As pointed out in some detail hereabove, however, the presence of such teeth on a backhoe bucket severely limit the use of the machine for anything except digging. In many cases, it could well be used for other purposes such as back filling holes and trenches, leveling and grading, particularly for relatively small or emergency jobs where it would not be feasible either economically or time-wise to bring in graders and other specialized equipment.

While others have advanced various proposals for overcoming the limitations and problems created by the teeth present on the usual backhoe bucket, the present invention provides what is believed to be the first commercially viable solution to those problems. In this connection, attention is first called to FIG. 1, in which the bucket 14 is shown as carrying a scraper blade 56 mounted on the outer tapered end of the teeth 54, with binding means 58 securing the blade 56 against movement in response to the major pressures and forces generated during use of the blade in scrapping or leveling dirt in the manner illustrated in FIG. 1.

As best shown in FIGS. 2–7, blade 56 includes a front plate 60 formed of a tough steel sheet material and comprised of a generally planar rectangular center section 62 having extending from each end thereof a relatively short rectangular end section 64. As will be noted, the end sections 64 are angled inwardly toward center section 62. As the blade is being used to scrape or level dirt in the manner illustrated in FIG. 1. these inward angled end sections 64 will effectively guide dirt toward the center section 62 as it is encountered by blade 56, thus eliminating or substantially reducing any spill over or loss of dirt from the ends of the blade. The specific angle selected for use in positioning the end sections 64 with respect to the plane of center section 62 is not critical, but an angle of about 45° has been found desirable in the preferred embodiment. Also, it should be noted that while the center section 62 and end sections 64 of front plate 60 are shown as being formed from a single elongate piece of steel sheet, it will be understood that the end sections 64 could be separate pieces welded or otherwise affixed to the ends of the center section 62.

Back plate 66, also formed of a tough rectangular steel sheet, is generally planar and of substantially the same size as and is generally congruent with the center section 62 of the front plate 60. The lower edge of back plate 66 is welded or otherwise affixed to the lower edge of the center section 62, with the plates diverging away from each other at an angle substantially equal to the angle of the taper of the outer or pointed end of teeth 54. Thus, as will be explained in further detail herebelow, the tapered portion of teeth 54 will readily yet securely and snugly fit in the "V" shaped space provided between center section 62 and back plate 66. A plurality of steel spacers 68, cut at the same angle as the taper of the teeth 54, are positioned between and welded to center section 62 and back plate 66. In the illustrated embodiment, one spacer 68 is disposed at each end of the center section 62, with two additional spacers 68 being located centrally of the blade and spaced far enough apart to receive therebetween the center tooth 54 of bucket 14. To avoid any likelihood of deflection or deformation of the end sections 64 of front plate 60 in response to pressures and impacts experienced during use of the blade 56, it is desirable to reinforce the end sections 64 as by welding horizontal and angled braces 65 and 67 between each end section and the adjacent end spacer 68.

The center section 62, plate 66 and spacers 68 define an upwardly open receptacle or socket 70 which is sized and configured to snugly and securely yet releasably receive the outer tapered ends or points of the teeth 54. As the teeth 54 approach the fully seated position best illustrated in FIG. 7, a wedging action occurs between the tapered surfaces of the socket 70 and teeth 54 which is quite sufficient to prevent any wobble of the blade 56 relative to the teeth 54 or bucket 14. Further because of the relatively close fit between the centrally positioned spacers 68 and the center tooth 54, the blade 56 is restrained against any significant sideways movement relative to the teeth 54 and bucket 14. Accordingly, so long as the blade 56 is held tightly over the teeth 54, it will not shift, wobble or vibrate as it is being used to scrape, level or grade dirt.

In the preferred embodiment of this invention, the scraper blade 56 is held securely and tightly over the teeth 54 of bucket 14 by binder means 58, comprising a simple and inexpensive yet effective and easily operated mounting system which can be handled readily by one person without the need for tools or other aids. This system 58 includes (i) anchor means comprising a hook member 78 removably attachable to a fixed support member consisting of a rod 72 mounted in aligned apertures 74 in the mounting brackets 47 of bucket 14, (ii) connector means such as a link or shackle 76 welded or otherwise provided on and positioned substantially intermediate the ends of the back plate 66 of scraper blade 56, and (iii) a binder assembly 59 operatively positioned between and releasably connected to the support rod 72 by hook member 78 and to the shackle 76 by a steel tether chain 80. Preferably, tether chain 80 is permanently linked to shackle 76 and is long enough to accommodate use of the scraper blade on buckets of various sizes.

Although other types of binder assemblies may be used, in the preferred embodiment the binder assembly 59 includes an operating arm or lever 82 having proximate one end a first pivot 84 which rotatably couples the lever 82 to link 86 which, in turn, is coupled to hook member 78. Spaced outwardly of pivot 84 toward the free distal end of lever 82 is a second pivot 88 which rotatably couples the lever 82 to a second link or clevis 90 on which a swivel hook 92 is suspended. In turn, hook 92 is adapted to receive and removably hold a link of the tether or chain 80. Accordingly, when the parts are connected in the manner shown, as the lever 82 is rotated upwardly around pin 84, the clevis 90, hook 92 chain 80 shackle 76 and blade 56 all will be pulled upwardly toward support rod 72 until the teeth 54 of bucket 14 are fully seated in the socket 70 of blade 56 and the lever 82 is fully rotated to its upper position. The first and second pivots 84 and 88 are spaced from one another both longitudinally and transversely of a line extending between the pivots 84 and 88 and along the length of said lever such that after the lever 82 has been fully rotated to its upper position the tension in the binder system, acting through the axially offset relationship of the pivots 84 and 88, will hold the lever in that position. Manual rotation of lever 82 from its upper to its lower position will, of course, relieve the tension in the binder system and permit removal of hook member 78 from support rod 72 and chain 80 from hook 92 and removal of the binder assembly 59 from the bucket 14 and the blade 56 from teeth 54.

From the above description it will be seen that this invention provides a blade attachment which will substantially increase the versatility of the usual backhoe without adversely affecting or interfering with its primary function of digging and trenching. For instance, after a backhoe operator has completed a trench or other excavation and the necessary pipe laid or other under ground work completed, closure of the trench or excavation can be accomplished readily and effectively by the addition of scraper blade 56 to the bucket 14. Mounting of the blade can be effected quickly and easily by either of two procedures. As the first step in either procedure, the hook member 78 and attached binder assembly 59 should be suspended from support rod 72 and laid over the upper curved surface of the bucket 14. Secondly, the operator can then place the blade 56 in an upright position on the ground, position the bucket 14 over the blade 56 with the teeth 54 aligned with socket 70, lower the bucket 14 to insert the teeth 54 into the socket 70, connect the tether chain 80 between the shackle 76 and hook 92 and then raise the lever 82 from its lower position to its upper position to effect securement of the blade 56 on the bucket 14. Alternately, particularly if the blade is of a smaller size and lighter weight, the operator should be able easily to lift the blade 56 and fit it into place on the bucket 14 with the teeth 54 started into socket 70, connect the chain 80 to hook 92 and then raise the lever 82 to secure the blade 56 in operating position.

After the trench or excavation has been back filled and the disturbed ground leveled and graded using the bucket 14 equipped with the scraper blade 56 as above described, the blade is quickly and easily removed from the bucket 14 simply by lowering the bucket to the ground, moving the lever 82 from its upper to its lower position to relieve the tension holding the blade in position on the bucket 14, disconnecting the tether chain 80 from hook 92, removing hook member 78 and binder assembly 59 from support rod 72 and then simply raising the bucket to withdraw the teeth 54 from the socket 70. Thus, in a matter of perhaps 1 or 2 minutes the blade of this invention can be mounted on a bucket and then later removed in probably even less time—all by one person without the use of tools or other mounting aids.

One unique feature of the present invention is the provision of the single binder means in securing the scraper blade on the bucket. This unique arrangement provides a balanced even pressure between the teeth of the bucket and the interior of the socket of the scraper blade throughout the length of their contact. Thus, there is no danger that one end of the blade will be loose and the other end tight—a condition which could easily occur in the case of multiple bindings because of carelessness and/or vibration during use. Another important advantage provided by the present invention is that the center mounting system makes it both possible and practical to mount either a wide or narrow scraper blade on either a wide or narrow bucket. For example, a four foot blade can be mounted on a two foot bucket, or a two foot blade on a four foot bucket. Thus, while a narrow blade normally would not be used on a wide bucket, one could be mounted and used quite successfully on a wide bucket in case of an unusual need, an emergency or if a narrow bucket should not be available.

Figure 10:
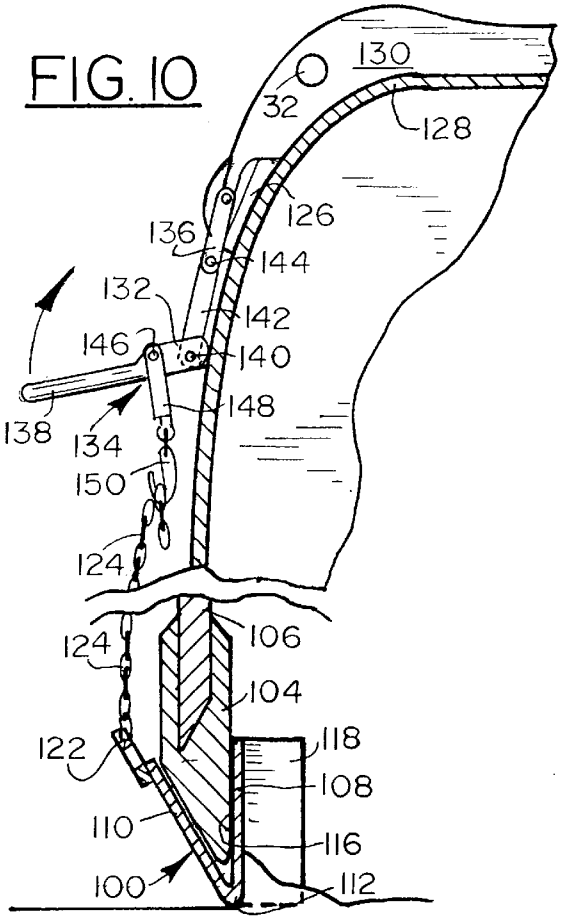
FIG. 10 is a side elevational view, partially in cross section and partially enlarged, as taken along the line 10—10 of FIG. 9, showing the details of the binder assembly and scraper blade structure of the embodiment of FIG. 8.
Figure 8:
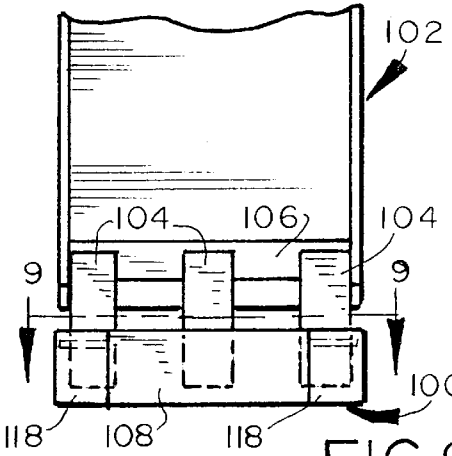
FIG. 8 is a front elevational view of another embodiment of the invention wherein the front and back plates of the scraper blade are formed of one piece of metal which is bent to define the straight lower scraping edge.
Figure 9:
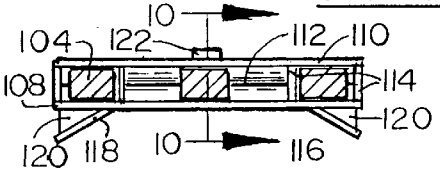
FIG. 9 is a top plan view of the blade of FIG. 8 as taken along the line 9—9 in FIG. 8.
Figure 7:
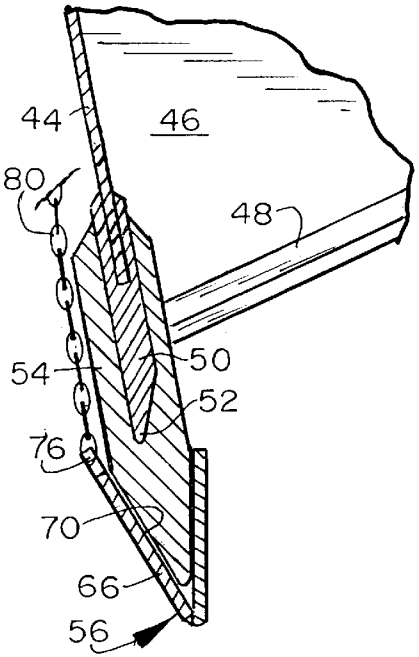
FIG. 7 is a cross sectional view of the scraper blade as taken along the line 7—7 of FIG. 6, with the addition of a section of the toothed bucket as illustrated in FIGS. 1,2 and 3.

Referring now to the embodiment of FIGS. 8, 9 and 10, a relatively narrow scraper blade 100 is shown as being mounted for use on a relatively narrow bucket 102 having only three digging/cutting teeth 104. Normally, it would be preferable to use a wider blade for backfilling, leveling or grading, even on a narrow bucket, but in some cases a narrow blade of this nature is needed for special work such as leveling the bottom of a narrow trench.

As best shown in FIGS. 8 and 10, the lower forward edge of the bucket 102 includes a reinforcing bar 106 having a tapered outer cutting edge, with the teeth 104 being mounted on bar 106 and tapering to a point. Scraper blade 100 includes front and back plates 108 and 110 which are generally rectangular and of substantially the same size, both being formed from a single component comprising a larger rectangular sheet of a tough steel alloy which is bent along a bisecting line, with the apex or bend 112 of the plates forming a straight lower scraping edge for the blade 100. As will be noted particularly from FIG. 10, the plates 108 and 110 diverge at an angle substantially matching the taper of the teeth 104. whereby securement of blade 100 on bucket 102 will result in solid yet releasable linear contact between the teeth 104 and the interior surfaces of front and back plates 108 and 110 of blade Referring particularly to FIG. 9, there are several tapered spacers 114 disposed between and welded to the plates 108 and 110, one spacer being positioned at each end of the plates, and one disposed inwardly of each end spacer a distance sufficient to receive one of the teeth 104 therebetween. Thus, the angled space between plates 108 and 110 and spacers 114 form an upwardly open receptacle or socket 116 adapted to releasably receive the pointed or tapered portion of teeth 104 upon attachment of blade 100 to bucket 102.

Angled end sections 118 also are provided on front plate 108, but in this embodiment the end sections 118 are separate rectangular pieces welded or otherwise affixed to the front plate 108 and braced by triangular reinforcing pieces 120 welded between the end sections 118 and the front plate 108. Disposed generally centrally of back plate 110 is a shackle 122 connected to tether chain 124.

As will be indicated by FIG. 10, the mounting brackets of some backhoe buckets may not have apertures suitable for receiving and holding a fixed support member, such as support rod 72 in the preferred embodiment. Such a lack is of little significance, however, as a fixed support member can be added readily to bucket 102 the first time it is to be used with blade 100. Such a fixed support member could be provided in a variety of ways as, for example, by a rod either welded between mounting brackets 130 or provided with feet welded to the bucket between the brackets. In the present embodiment, however, the fixed support member preferably comprises a support hook 126 welded or otherwise permanently affixed to the upper part of the curved back wall 128 of bucket 102 at a point substantially mid way between the mounting brackets 130.

The scraper blade 100 is selectively secured on and released from the teeth 104 of bucket 102 by binder means 132 comprising an easily operated system including shackle 122 affixed to back plate 110 of blade 100, anchor means comprising clevis 136 adapted for releasable attachment to fixed support hook 126 of bucket 102, and binder assembly 134 operatively disposed between and releasably connected to shackle 122 by steel tether chain 124 and to the support hook 126 by clevis 136. In this embodiment, the binder assembly 134 consists of the same type of device as described previously with reference to the preferred embodiment. Briefly, the binder assembly 134 includes a manually operable lever 138 having proximate one end a first pivot 140 which rotatably couples the lever 138 to link 142. In turn, link 142 is suspended on clevis 136 by pin 144, with clevis 136 then being releasably attached to support hook 126. Spaced outwardly of pivot 140 toward the outer distal end of lever 138 is a second pivot 146 which rotatably couples the lever 138 with link or clevis 148 on which a swivel hook 150 is suspended. Tether chain 124 is then removably attached to swivel hook 148.

As will be clear from the above, with the parts appropriately connected, the operating lever 138 is movable manually around pivot 140 between a first upper position in which the hook 150, tether 124, shackle 122 and blade 100 are pulled toward support member 126 and the teeth 104 of bucket 102 are firmly seated in socket 116 of the scraper blade 100, and a second lower position in which the tension between the support hook 126 and shackle 122 is relieved to permit disconnection of the binder assembly from the support hook 126 and shackle 122 whereby the teeth 104 are freed for removal from socket 116 and the blade 100 is freed for removed from the bucket 102.

Obviously, many modifications and variations of the present invention are possible in light of the teachings of this application. It is to be understood, therefore, that the foregoing descriptions and appended drawings are illustrative only and are neither intended nor desired to limit the scope of this invention.

For example, a ratchet type turnbuckle device could be substituted for the lever operated binder assemblies discussed hereinabove. Or the tether chain could have two or more lower sections which flare out to provide more than one connection to the back plate of the blade. Also, it is to be understood that this invention is not to be limited to scraper blades of any specific length or width or to blades intended for use only on buckets of backhoes as such blades may provided in a significant range of sizes and also can be used on other kinds of earth working equipment such as end loaders.

Having thus described and illustrated certain preferred embodiments of the invention, what is claimed as new and novel and desired to be protected by letters patent is as follows:

I claim:

1. In a system for adapting an earth working bucket for use in scraping, leveling and grading dirt, wherein the bucket has a pair of spaced sides, a lower cutting edge extending between the sides, and a plurality of teeth spaced along and extending outwardly beyond (its) the cutting edge and provided with tapered points, said system comprising a scraper blade having front and back plates connected together to form a substantially straight lower scraping edge, said front and back plates being positioned to define therebetween an upwardly open space configured and sized to receive and releasably engage the tapered points of the teeth, an end section carried proximate each end of the front plate and positioned to divert dirt toward said front plate as dirt is scraped by said blade, manually operable binder means for tightening and securing said blade on said bucket with the tapered points removably seated within said upwardly open space, said binder means comprising anchor means releasably attachable to the bucket to provide a fixed support positioned intermediate the sides of the bucket and spaced from the cutting edge of the bucket, connector means carried by said blade intermediate its ends, a binder assembly disposed between and operatively coupled to said anchor means and said connector means, said binder assembly having a manually operable member mounted for movement to a first position pulling said connector means and said blade toward the fixed support a distance sufficient to seat and releasably hold the points of the teeth under tension within said upwardly open space, and to a second position to release the tension on said connector means and permit movement of said connector means away from the fixed support and withdrawal of the points of the teeth from said (opening) upwardly open space and removal of said blade and said binder assembly from said bucket.

2. The system according to claim 1, characterized by said front and back plates diverging away from each other at an angle substantially equal to the taper of the points of the teeth, and said upwardly open space between said front and said back plates comprising a generally "V" shaped socket adapted to removably receive and snugly engage the tapered points of the teeth.

3. The (A) system according to claim 2, characterized by said front plate comprising a generally rectangular center section (with) having spaced upper and lower edges and spaced ends, said end sections being integral with and extending from said (the) ends of said center section, said back plate being generally rectangular and having spaced upper and lower edges and spaced ends, said back plate being substantially equal in size to and disposed in general congruence with the center section of the front plate, the lower edges of said front and back plates being connected together and providing said substantially straight lower scraping edge for said scraper blade, and a plurality of tapered spacers fixed between said front and back plates, with one spacer being positioned proximate each end of said center section.

4. The (A) system according to claim 2 wherein a pair of mounting brackets are affixed to the (upper end of the) bucket in a spaced relation with said cutting edge, characterized by a fixed support (member) carried by the brackets, said anchor means comprising a hook member releasably attachable to the fixed support (member), said connector means comprising at least one (a) connecting member generally centrally positioned proximate the upper edge of said back plate, and coupling means for releasably coupling said binder assembly to the fixed support (member) and said connecting member, said coupling means comprising said hook member, a first link member connected to said hook member and said binder assembly, and tether means connected to said connecting member and releasably engagable with said binder assembly.

5. The (A) system according to claim 4, characterized by said binder assembly providing a manually operable lever having a first pivot rotatably coupling said lever with said first link member and a second pivot spaced (axially) from said first pivot, a second link member rotatably coupled to said lever by said second pivot and provided with a chain hook, said connecting member comprising a shackle fixed to said back plate, said tether means comprising a length of chain connected at one end to said shackle and at the other end being releasably engagable with said chain hook, the positioning of said first and said second pivots (pivot) being such that(offset transversely from the longitudinal axis of said lever whereby) in moving said lever to its first position tensioning the system to seat the teeth in said upwardly open space (receptacle), said tension will releasably maintain the lever in such position.

6. The system according to claim 1, characterized by said front and back plates being individual plates of generally rectangular configuration disposed in general congruence, with their lower edges being joined together as by welding to provide said scraping edge.

7. The system according to claim 1, characterized by said front and back plates comprising a single integral component of generally rectangular configuration bent along a line bisecting said component and forming said scraping edge.

8. The (A) system according to claim 1, wherein the bucket has a back wall extending between the sides and terminating in an upper edge spaced from said cutting edge. and two mounting brackets affixed in a spaced parallel relationship to said back wall proximate its upper edge (the upper end of the bucket), characterized by said anchor means being removably attachable to a support member fixed on the (upper end of the) bucket proximate the mounting brackets, said connector means comprising at least one connecting member carried by said back plate, and coupling means for releasably coupling said binder assembly to said anchor means and said connector means.

9. The (A) system according to claim 8, characterized by said anchor means comprising a hook member releasably attachable to a (tia) support member carried by the mounting brackets of the bucket, said connector means comprising at least one shackle (generally centrally) positioned on said back plate, said coupling means comprising link means releasably connecting said binder assembly and said hook member, and tether means (mean) releasably connecting said binder assembly and said at least one shackle.

10. The system according to claim 9 characterized by said manually operable member comprising a lever having a first pivot rotatably coupling said lever with said link means and a second pivot spaced from said first pivot and rotatably coupling said lever with said tether means, said lever being rotatable around said first pivot in being moved manually between its said first and second positions.

11. In a system for adapting an earth working bucket for use in scraping, leveling and grading dirt, wherein the bucket has a pair of spaced sides, a back wall extending between the sides and terminating in upper and lower edges, a cutting edge extending along the lower edge of the back wall between the sides, a pair of mounting brackets affixed in a spaced parallel relationship to the back wall (upper end) of the bucket proximate its upper edge, and a plurality of teeth spaced along and extending outwardly beyond the (lower) cutting edge of the bucket and terminating in tapered points, said system comprising a scraper blade comprising a front plate having a generally rectangular center section having spaced ends and spaced upper and lower edges, and a generally rectangular end section extending outwardly from each end of said center section, said end sections extending outwardly beyond and being angled inwardly toward said center section, a generally rectangular back plate having spaced ends and spaced upper and lower edges, said back plate being substantially equal in size to and disposed in general congruence with said center section, the lower edge of said back plate being joined to the lower edge of said center section to define a substantially straight lower scraping edge for said blade, said back plate and said center section diverging away from each other at an angle substantially equal to the (angle of the) taper of the teeth, a plurality of spacers disposed between and fixed to said center section and said back plate, said center section and said back plate defining an upwardly open generally "V" shaped socket sized and configured to releasably but tightly receive the tapered points of the teeth, binder means for securing said blade on the bucket upon assembly of the bucket and said blade with the tapered points of the teeth proximate to and in general alignment with said socket, said binder means comprising a hook member adapted for releasable attachment to a fixed support (member) carried by the mounting brackets of the bucket, a connecting member carried by and disposed generally centrally of said back plate, a tether coupled to said connecting member, a binder assembly operatively disposed between said hook member and said connecting member and comprising a first link releasably engaging said hook member, a second link releasably engaging said tether, a manually operable lever having proximate one end thereof a first pivot rotatably coupling said first link to said lever, and a second pivot spaced (axially) from said first pivot and rotatably coupling said second link to said lever, said lever being manually rotatable around said first pivot to a first position to pull said second link and said tether and the (bucket) scraper blade toward said fixed support member a distance sufficient to securely seat and releasably hold the tapered points of the teeth firmly under tension within said socket, and to a second position to relieve the tension on said second link and said tether and the scraper blade (bucket) to permit withdrawal of the points of the teeth from said socket and removal of said blade and said binder assembly from the bucket.

* * * * *

UNITED STATES PATENT AND TRADEMARK OFFICE

CERTIFICATE OF CORRECTION

PATENT NO. : 5,918,389

DATED : July 6, 1999

INVENTOR(S) : William I. Hall

It is certified that error appears in the above-identified patent and that said Letters Patent is hereby corrected as shown below:

Column 8, Line 54, following "blade" add --100.--

Column 10, Line 14, delete "(its)"
Line 48, delete "(opening)"
Line 59, delete "(A)"
Line 61, delete "(with)"
Line 64, delete "(the)"

Column 11, Line 10, delete "(A)"
Line 11, delete "(upper end of the)"
Line 14, delete "(member)"
Line 16, delete "(member)"
Line 17, delete "(a)"
Line 21, delete "(member)"
Line 28, delete "(A)"
Line 32, delete "(axially)"
Line 41, delete "(pivot)"
Lines 42 & 43, delete "(offset transversely from the longitudinal axis of said lever whereby)"
Line 45, delete "(receptacle)"
Line 57, delete "(A)"
Lines 61 & 62, delete "(the upper end of the bucket)"
Line 64, delete "(upper end of the)"

Column 12, Line 4, delete "(A)"
Line 6, delete "(tia)"
Line 9, delete "(generally centrally)"
Line 13, delete "(mean)"

UNITED STATES PATENT AND TRADEMARK OFFICE

CERTIFICATE OF CORRECTION

PATENT NO. : 5,918,389

DATED : July 6, 1999

INVENTOR(S) : William I. Hall

It is certified that error appears in the above-identified patent and that said Letters Patent is hereby corrected as shown below:

Column 12, Line 27, delete "(upper end)"
Line 30, delete "(lower)"
Line 48, delete "(angle of the)"
Line 60, delete "(member)"
Column 13, Line 6, delete "(axially)"
Line 10, delete "(bucket)"
Column 14, Line 6, delete "(bucket)"

Signed and Sealed this

Twenty-sixth Day of September, 2000

*Attest:*

Q. TODD DICKINSON

*Attesting Officer*

*Director of Patents and Trademarks*